US005544645A

United States Patent [19]

Armijo et al.

[11] Patent Number: 5,544,645

[45] Date of Patent: Aug. 13, 1996

[54] COMBINATION WATER HEATING AND SPACE HEATING APPARATUS

[75] Inventors: David L. Armijo, Plano; Tony R. Baker, Highland Village; Floyd E. Cherington; Delbert S. Christopher, both of Carrollton; David J. Moody, Allen; James J. Mullen, Carrollton; Hugh E. Vinson, Hurst; John L. Warren, Grand Prairie, all of Tex.; Robert C. Beilfuss, Smyrna, Tenn.; John H. Wiker, Plainfield, Ill.

[73] Assignee: Lennox Industries Inc., Dallas, Tex.

[21] Appl. No.: 296,112

[22] Filed: Aug. 25, 1994

[51] Int. Cl.[6] ..... F24D 9/00

[52] U.S. Cl. ..... 126/101; 126/116 A; 126/361; 237/8 B; 237/8 C

[58] Field of Search ..... 126/101, 116 A, 126/361, 364, 362; 431/90; 237/8 B, 8 C

[56] References Cited

U.S. PATENT DOCUMENTS

| | | | |
|---|---|---|---|
| 2,787,318 | 4/1957 | Wolfersperger . | |
| 3,741,710 | 6/1973 | Nelson | 431/90 |
| 4,158,386 | 6/1979 | Hapgood | 126/101 X |
| 4,178,907 | 12/1979 | Sweat, Jr. | 126/101 |
| 4,222,350 | 9/1980 | Pompei et al. | 122/32 |
| 4,241,720 | 12/1980 | Kitchen | 126/110 C |
| 4,336,820 | 6/1982 | Jorgensen et al. | 137/100 |
| 4,371,111 | 2/1983 | Pernosky | 126/101 X |
| 4,398,502 | 8/1983 | Park | 126/364 X |
| 4,449,484 | 5/1984 | Sakamoto et al. | 126/361 X |
| 4,492,185 | 1/1985 | Kendall et al. | 126/361 X |
| 4,541,410 | 9/1985 | Jatana | 126/362 |
| 4,584,987 | 4/1986 | Rotili | 126/514 |
| 4,641,631 | 2/1987 | Jantana | 126/101 |
| 4,766,883 | 8/1988 | Cameron et al. | 126/351 |
| 5,022,352 | 6/1981 | Osborne et al. | 126/361 X |

OTHER PUBLICATIONS

"The Application of Combustion Principles to Domestic Gas Burner Design"; H. R. N. Jones, MA, PhD, CEng, MIGasE, British Gas Teaching Fellow, University of Cambridge; 1989.

*Primary Examiner*—Larry Jones
*Attorney, Agent, or Firm*—W. Kirk McCord

[57] ABSTRACT

A combination water heating and space heating apparatus includes a water heating unit and a space heating unit releasably coupled with the water heating unit. The water heating unit has a water storage tank and a helically wound tubular heat exchanger inside the tank for exhausting products of combustion from a combustion chamber located in a top part of the tank and for transferring heat from the products of combustion to the surrounding water. The space heating unit is an air handler with an hydronic heat exchanger coil and a blower for blowing air over the coil. Hot water is supplied from the tank to the coil and is returned to the tank by means of a water circulation pump located in the space heating unit. Air blown over the coil is heated by the hot water flowing over the coil. The water heating unit and the space heating unit are coordinately controlled such that priority is given to the potable hot water supply over space heating in the event that sufficient hot water is not available to satisfy both demands. Further, the water heating unit anticipates the additional demand for hot water in response to a demand for space heating by raising the tank temperature setpoint so that the water heating operation is usually initiated, even if the temperature of the water in the tank was already at the original tank temperature setpoint when the demand for space heating occurred.

19 Claims, 14 Drawing Sheets

COMBINATION WATER HEATING AND SPACE HEATING APPARATUS

FIELD OF INVENTION

This invention relates generally to heating apparatus and in particular to combination water heating and space heating apparatus.

BACKGROUND ART

Due to the continually increasing cost of fuel, such as natural gas, greater emphasis has been placed on fuel efficiency in the design and construction of heating apparatus, such as furnaces and water heaters. One development has been the replacement of the conventional pilot light with either direct spark ignition, intermittent pilot ignition or hot surface ignition. Another development has been the use of a helically wound tubular heat exchanger to circulate the products of combustion through a hot water storage tank, by which heat is transferred from the products of combustion to the water in the tank.

Combination water heating and space heating apparatus, as shown, for example, in U.S. Pat. Nos. 4,541,410, 4,641,631 and 4,766,883, are known in the art. In such combination apparatus, hot water is circulated between a hot water storage tank and an hydronic heat exchanger coil located in an air supply duct to heat the air passing over the heat exchanger coil, thereby providing heated air to an indoor space. One problem associated with such prior art combination apparatus is the allocation of hot water between space heating and the normal hot water supply (e.g., hot water for domestic use). If there is a concomitant demand for space heating and for domestic hot water (e.g., showers, laundry, dishwasher, etc.), the hot water supply may be insufficient to satisfy the demand. Another problem is that the combustion chamber of the water heater is typically located at the bottom of the tank. As such, water in the tank is in direct contact with the sides and top of the combustion chamber, but not the bottom, thereby detracting from the efficiency of the apparatus. Further, water heated at the bottom of the tank rises to the top of the tank and is replaced by colder water sinking to the bottom of the tank. This natural convection is advantageous in terms of circulating water throughout the tank, but is disadvantageous in terms of being able to rapidly heat water to a desired temperature for immediate use (e.g., for space heating).

There is, therefore, a need for an improved water heating apparatus and for an improved combination water heating and space heating apparatus.

DISCLOSURE OF INVENTION

In accordance with the present invention, combination water heating and space heating apparatus is provided. The apparatus includes a water heating unit and a space heating unit. The water heating unit has a water storage tank, heating means for heating water stored in the tank and first temperature sensing means for sensing water temperature in the tank and for providing a first electrical signal in response to the water temperature being at least a first temperature increment below a first temperature setpoint corresponding to a desired water temperature. The first electrical signal indicates a demand for water heating. The space heating unit has an air duct for supplying air to an indoor space, a heat exchanger for heating the supply air, air moving means for moving air over the heat exchanger and second temperature sensing means for sensing air temperature in the indoor space and for providing a second electrical signal in response to the air temperature being at least a second temperature increment below a second temperature setpoint corresponding to a desired air temperature. The second electrical signal indicates a demand for space heating. Water circulation means is provided for circulating water between the tank and the heat exchanger in the supply air duct. The apparatus further includes control means adapted to control the heating means, the water circulation means and the air moving means. The control means is responsive to the first electrical signal for controlling the heating means to heat the water in the tank. The control means is responsive to the second electrical signal for controlling the water circulation means to supply heated water from the tank to the heat exchanger and the air moving means to move air over the heat exchanger, whereby air to be supplied to an indoor space is heated. The control means is further responsive to the second electrical signal for raising the first temperature setpoint by a predetermined amount.

In accordance with one aspect of the invention, the water heating unit includes a combustion chamber, conduit means in fluid communication with the combustion chamber, air supply means for delivering air to the conduit means, air flow restricting means located in the conduit means for metering the flow of air through the conduit means, fuel supply means responsive to a pressure differential across the air flow restricting means for delivering fuel (e.g., natural gas) to the conduit means downstream Of the air flow restricting means, fuel flow restricting means located between the fuel supply means and the conduit means for metering the flow of fuel to the conduit means, blower means in fluid communication with the conduit means downstream of the airflow restricting means for drawing air through the conduit means and for introducing a combustible fuel-air mixture into the combustion chamber, and igniter means for igniting the fuel-air mixture in the combustion chamber. The control means is adapted to enable the igniter means to ignite the fuel-air mixture in response to the first electrical signal and to disable the blower means for a predetermined time in response to the igniter means being enabled. Disabling the blower means during ignition provides a fuel-rich mixture for "softer" (i.e., low fire) lighting, thereby reducing the noise and pressures typically associated with direct ignition.

In accordance with another aspect of the invention, the combustion chamber is a substantially sealed chamber defined by a liquid impervious housing suspended within the tank from a top part thereof, such that the housing is substantially immersed in water when the tank is filled with water. A burner is located in the combustion chamber for burning the fuel-air mixture. First conduit means is provided for introducing the fuel-air mixture into the combustion chamber and second conduit means is provided for exhausting products of combustion from the combustion chamber. The housing has a frusto-conical top portion and a substantially cylindrical main body portion below the frusto-conical top portion. A spacing is provided between the frusto-conical top portion and the top part of the tank such that water in the tank is able to contact the frusto-conical top portion as well as the main body portion of the combustion chamber housing, thereby enhancing heat transfer between the combustion chamber and the water in the tank.

In accordance with yet another aspect of the invention, the second conduit means is comprised of a helical tube having a plurality of turns spaced at sufficient intervals along a central axis of the helical tube to accommodate another helical tube having a plurality of turns with each turn of the other helical tube interposed between successive turns of the helical tube. When the second conduit means includes first and second helical tubes, each of the turns of the first helical tube is interposed between successive turns of the second helical tube in concentric relationship therewith and each of the turns of the second helical tube is interposed between successive turns of the first helical tube in concentric relationship therewith. The helical tubes extend outwardly from the combustion chamber housing and downwardly in the tank for transferring heat from the products of combustion in the tubes to the surrounding water. This double tube configuration enhances the heat transfer capacity without requiring additional special tooling to form a single helical tube into the tightly wound helical configuration defined by the first and second helical tubes.

In accordance with still another aspect of the invention, the water circulation means is adapted to supply heated water from the top part of the tank to the heat exchanger in the supply air duct and to return water from the heat exchanger to the top part of the tank. In accordance with one embodiment of the invention, a water supply conduit communicates between the tank and the heat exchanger for supplying water from the tank to the heat exchanger and a water return conduit communicates between the tank and the heat exchanger for returning water from the heat exchanger to the tank. The water circulation means is cooperative with the supply and return conduits to provide a circumferential flow of water around the combustion chamber housing, thereby enhancing the transfer of heat from the combustion chamber to the water to be supplied to the heat exchanger for space heating.

The combination apparatus according to the present invention provides energy-efficient space heating and water heating. The control means of the apparatus is adapted to control the allocation of hot water to give priority to the potable water supply over space heating if the water temperature in the storage tank drops below a minimum temperature threshold. In the preferred embodiment, the minimum temperature threshold is a predetermined third temperature increment (which is greater than the first temperature increment) below the first temperature setpoint. When this low temperature condition occurs, hot water from the tank will not be circulated to the heat exchanger in the supply air duct, even if the second electrical signal indicating a demand for space heating is present. The apparatus is programmed to try to prevent this condition from occurring by anticipating the hot water needed to satisfy a space heating demand. In response to a space heating demand, the first temperature setpoint is raised by a predetermined amount (e.g., 5° F.), such that a demand for space heating will usually trigger the tank heating operation, even if the water in the tank is already at the original first temperature setpoint when the demand for space heating occurred. Potable hot water shortages should, therefore, be prevented, except under extreme conditions.

BEST MODE FOR CARRYING OUT THE INVENTION

The best mode for carrying out the invention will now be described with reference to the accompanying drawings. Like parts are marked in the specification and drawings with the same respective reference numbers. In some instances, proportions may have been exaggerated in order to depict certain features of the invention.

Figure 1:
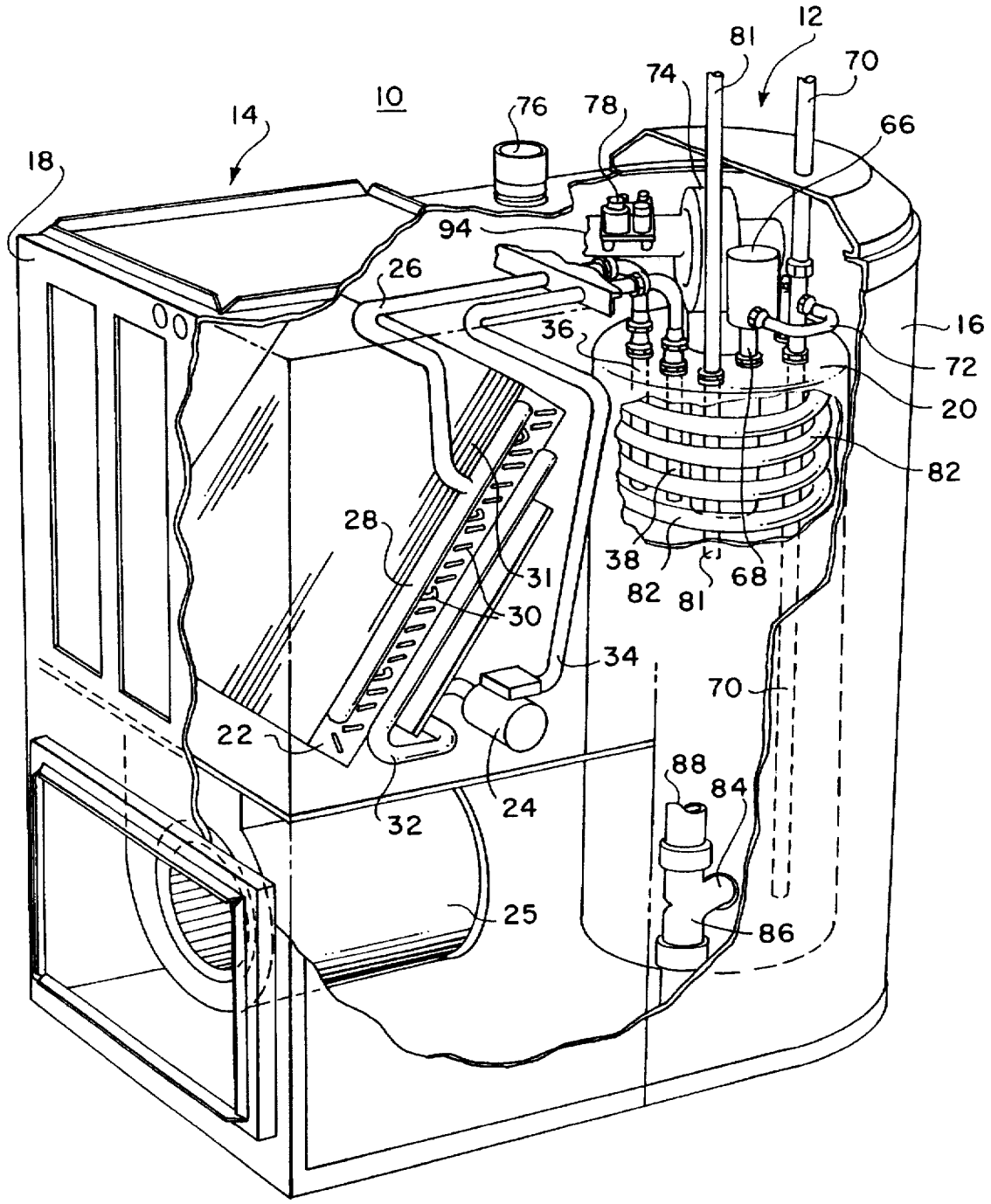
FIG. 1 is a partial cutaway, perspective view of a combination water heating and space heating apparatus having a water heating unit and a space heating unit, according to the present invention.
Figure 2:
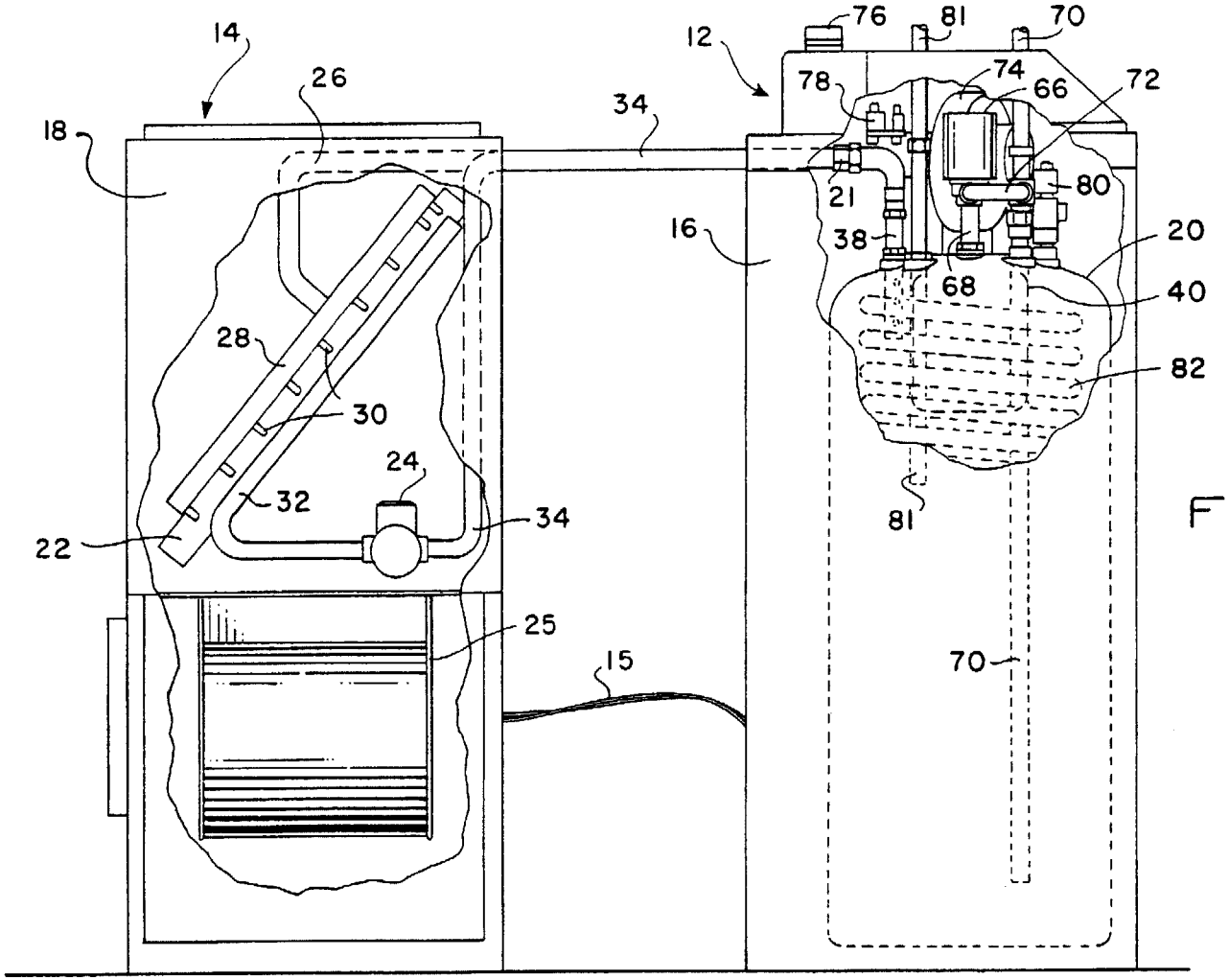
FIG. 2 is a partial cutaway, elevation view of the apparatus.

Referring to FIGS. 1 and 2, a combination water heating and space heating apparatus 10 includes a water heating unit 12 and a space heating unit 14. In FIG. 1, units 12 and 14 are depicted in a side-by-side configuration with unit 14 positioned for "up flow" operation (i.e., air is blown upwardly through unit 14). Although not shown in the drawings, one skilled in the art will recognize that alternatively unit 14 may be positioned for "down flow" (i.e., air is blown downwardly through unit 14) or "side flow" (i.e., unit 14 is positioned horizontally for horizontal air flow) operation. Further, unit 14 may be spaced apart from unit 12, with water flow piping and electrical connections 15 therebetween, as shown in FIG. 2. Depending on its capacity, unit 12 may be used to supply hot water to a plurality of space heating units 14 (e.g., zoned space heating with one unit 14 operatively associated with each zone). Further, unit 12 may be used to supply hot water to one or more low temperature baseboard heaters, to one or more radiant floor heaters, or to any combination of space heating units 14, baseboard heaters and radiant floor heaters. Further, unit 12 is operable as a stand-alone water heater.

Unit 12 is housed in a heavy gauge steel casing 16. Unit 14 is housed in a steel cabinet 18, the interior of which is insulated with fiberglass insulation in the conventional manner. Unit 14 is adapted to engage a supply air duct (not shown) of a space conditioning system, such that the interior of cabinet 18 forms part of the supply air duct. Cabinet 18 is adapted to receive an air conditioning evaporator coil, electronic air cleaner, humidifier and other conventional accessories.

Figure 3:
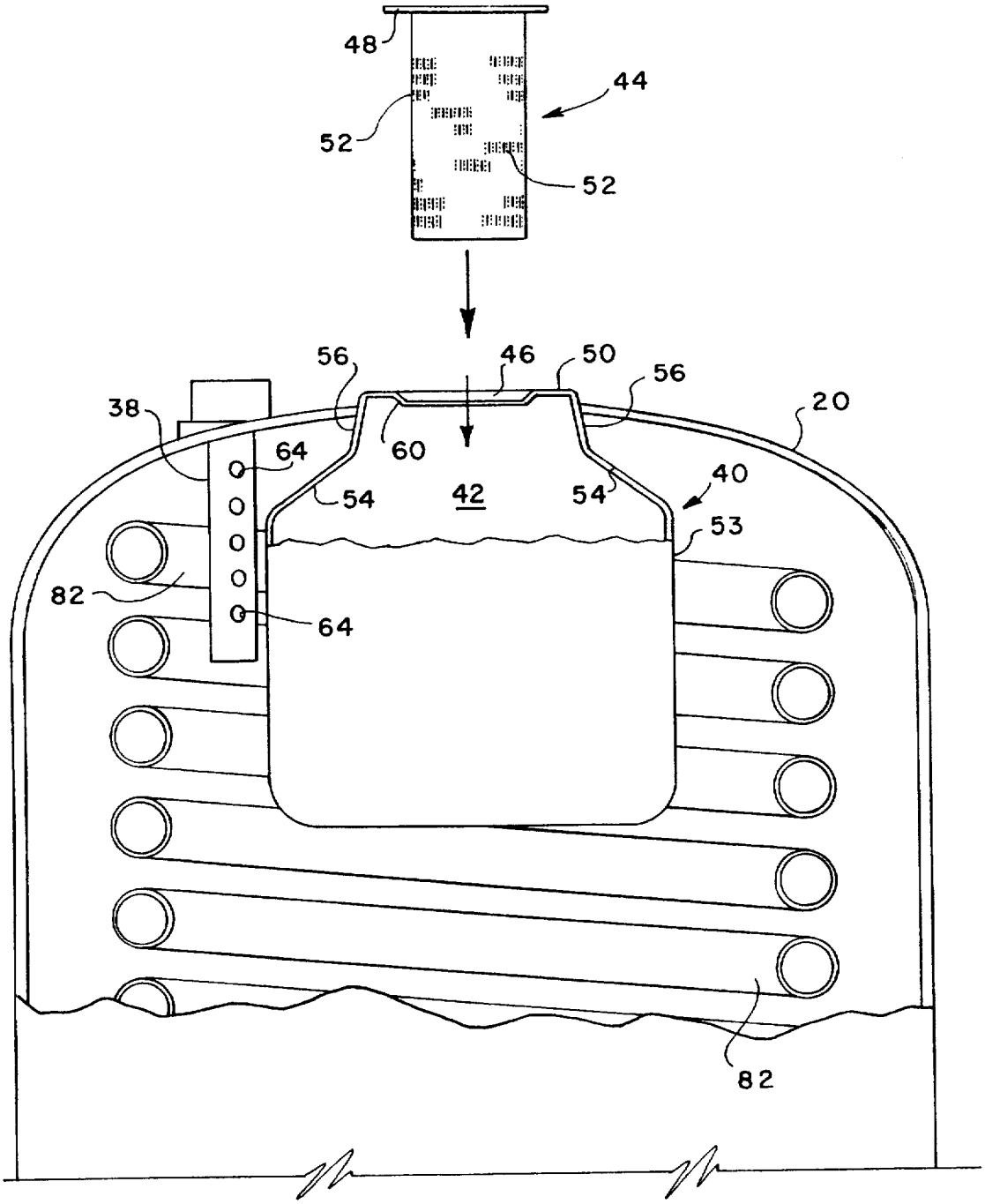
FIG. 3 is a partial cutaway, exploded view of an interior part of the water heating unit.
Figure 4:
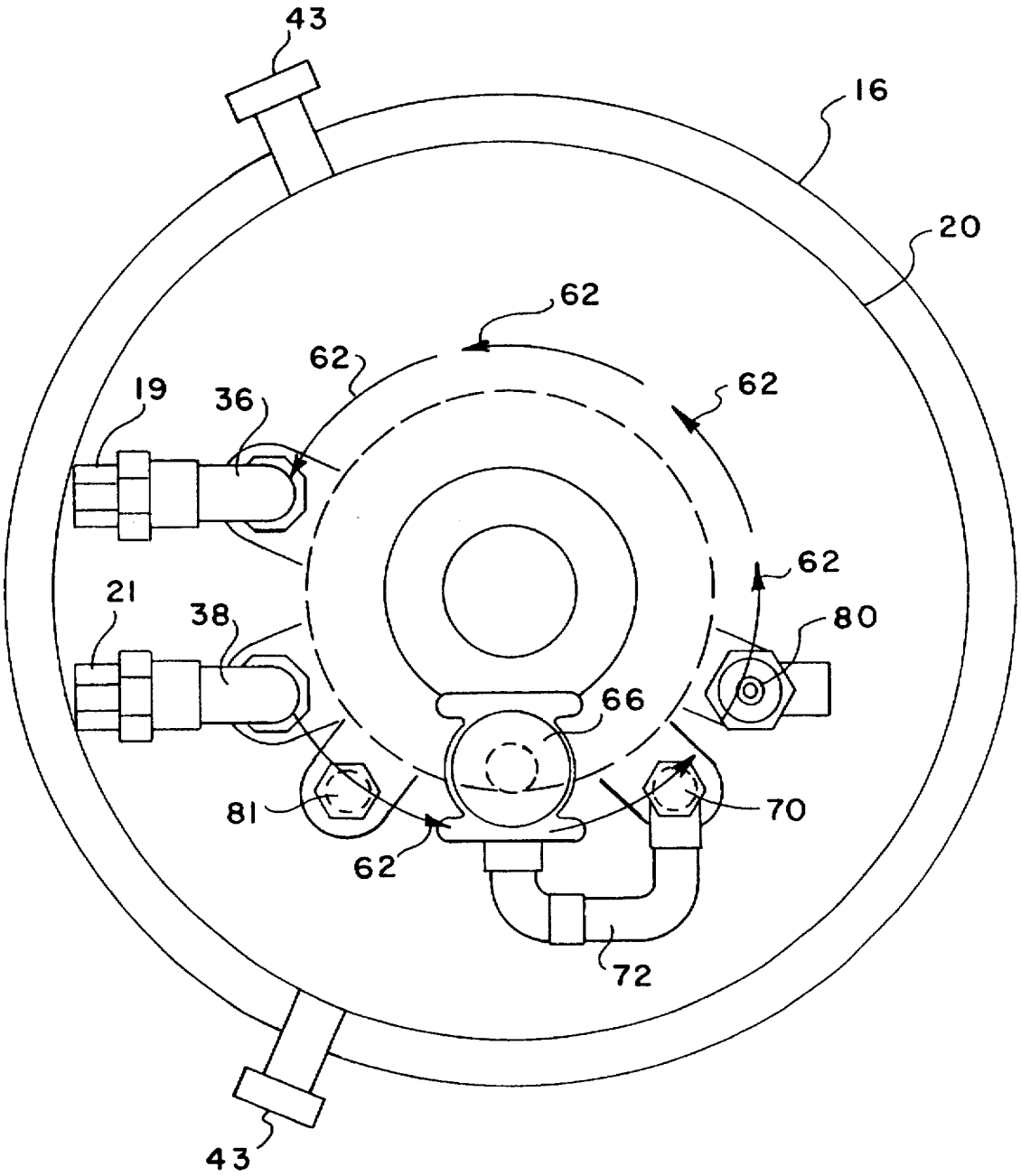
FIG. 4 is a top plan view of the water heating unit.

Referring also to FIGS. 3 and 4, unit 14 is an air handler releasably coupled to unit 12 by means of conventional releasable pipe couplings 19 and 21 (FIG. 4). As will be described in greater detail hereinafter, water is circulated between a water storage tank 20 inside casing 16 and a heat exchanger coil 22 inside cabinet 18. Coil 22 is a conventional hydronic coil with a plurality of tubes 30 and fins 31 extending between tubes 30. A water circulation pump 24 is also housed in cabinet 18 for drawing water from tank 20 through a supply conduit 26 into a supply manifold 28. Heated water is then distributed from supply manifold 28 through tubes 30 as in a conventional hydronic heat exchanger coil. The heated water makes multiple passes through tubes 30 and exits coil 22 into a return manifold 32 on the suction side of pump 24. Pump 24 returns the water to tank 20 through a return conduit 34 on the discharge side of pump 24. Both supply conduit 26 and return conduit 34 are in communication with the interior of tank 20 via respective dip tubes 36 and 38 (FIGS. 3 and 4). Supply conduit 26 is coupled to dip tube 36 and return conduit 34 is coupled to dip tube 38 by conventional releasable pipe couplings 19 and 21, thereby releasably coupling unit 14 to unit 12. A multiple speed blower 25 is housed in cabinet 18 for blowing supply air over coil 22, whereby the air is heated by the hot water flowing through tubes 30 and by fins 31. Coil 22 is located in one compartment of cabinet 18 and blower 25 is located in an adjacent compartment of cabinet 18, as in a conventional air handler.

Referring to FIGS. 3 and 4, tank 20 is an insulated stainless steel water storage tank having a capacity of approximately thirty gallons of hot water at adjustable temperatures ranging from 110° F. to 170° F. A liquid impervious housing 40 is suspended within tank 20 from a top part thereof, such that housing 40 is substantially immersed in the water stored in tank 20. Housing 40 defines a substantially sealed combustion chamber 42 inside housing 40. A gas burner 44, having the form of a hollow cylinder closed at its lower end but open at its upper end, is located in combustion chamber 42. Burner 44 extends downwardly through a central circular opening 46 in housing 40 into combustion chamber 42. An annular flange 48 extends radially outward from the upper end of burner 44. Housing 40 has an annular top flange 50 external to tank 20. Flange 50 is engageable with flange 48 to close off opening 46 after burner 44 has been inserted into combustion chamber 42 through opening 46. A gasket (not shown) is interposed between flanges 48 and 50 to provide a fluid-tight seal. Burner 44 has a plurality of small apertures 52 for establishing fluid communication between the interior of burner 44 and combustion chamber 42 surrounding burner 44. Burner 44 is selectively removable from and insertable into combustion chamber 42 through opening 46.

Housing 40 has a substantially cylindrical main body portion 53 and a frusto-conical top section comprising a first frusto-conical section 54 above main body portion 53 and a second frusto-conical section 56 above first frusto-conical section 54. First frusto-conical section 54 extends upwardly from main body portion 53 and is tapered inwardly at an angle of approximately 36° relative to a horizontal axis. Second frusto-conical section 56 extends upwardly from first frusto-conical section 54 and is tapered slightly inwardly at an angle of approximately 11° relative to a vertical axis. Second frusto-conical section 56 protrudes through a central circular opening in tank 20 and terminates at flange 50. Flange 50 extends radially inward from second frusto-conical section 56 and includes a downwardly extending inner-lip 60. Second frusto-conical section 56 is in contact with tank 20 to close off the tank opening. Second frusto-conical section 56 is secured to tank 20 (e.g., by welding) to suspend housing 40 within tank 20.

As can be best seen in FIG. 3, substantially the entire housing 40 is immersed in water, except for part of second frusto-conical section 56 and flange 50, which represent an insubstantial portion of the surface area of housing 40. Water is therefore able to come into direct contact with first and second frusto-conical sections 54 and 56) and main body portion 53 of housing 40, thereby enhancing the heat transfer between the products of combustion inside combustion chamber 42 and the surrounding water. Tank 20 has conventional drain valves 43 on a bottom portion of tank 20 for draining tank 20, as shown in FIG. 4.

Dip tubes 36 and 38 are configured to provide a circumferential flow of water around housing 40, as indicated by arrows 62. Dip tubes 36 and 38 are located in proximity to housing 40 and include a plurality of holes 64. Holes 64 of dip tube 38 discharge the water returning from coil 22 through return conduit 34 horizontally into tank 20. By the same token, the water to be supplied to coil 22 is drawn horizontally through holes 64 into dip tube 36 and upwardly into supply conduit 26. The respective locations of dip tubes 36 and 38 with respect to housing 40 are such dip tubes 36 and 38 cooperate with pump 24 to provide the circumferential flow of water, indicated by arrows 62. Because combustion chamber 42 is located in the top part of tank 20, the hottest water is generated in the top part of tank 20. Therefore, the circumferential flow of water around housing 40 picks up heat not only from the surrounding hot water, but also by direct contact with housing 40 as the water flows around housing 40, thereby further heating the water supplied to coil 22 for space heating.

Another water circulation pump 66 is located on top of tank 20 for circulating water within tank 20. The suction side of pump 66 is in fluid communication with the hot water in the top part of tank 20 by means of a suction line 68, which includes a check valve to ensure one-way flow. The discharge side of pump 66 is in fluid communication with a cold water fill line 70 by means of a discharge line 72. Cold water fill line 70, which is in fluid communication with a source of potable water (not shown), penetrates through the top of tank 20 and extends vertically downward through the interior of tank 20 to a position at or near the bottom thereof. Pump 66 is therefore operable to draw hot water from the top part of tank 20 and discharge the water into cold water fill line 70. The hot water introduced into fill line 70 by pump 66 mixes with the incoming cold water and is discharged from fill line 70 at or near the bottom of tank 20, thereby circulating water within tank 20 and providing relatively uniform heating of the water within tank 20 from top to bottom.

A combustion air blower 74 is mounted on top of tank 20 for providing a combustible gas-air mixture to burner 44. A combustion air intake duct 76 in fluid communication with an external air supply (not shown) supplies combustion air to blower 74 and an automatic gas valve 78 coupled to a gas fuel source (not shown) supplies gas fuel to blower 74. Gas and air are supplied to the suction side of blower 74. A temperature/pressure relief valve 80 is also mounted on top of tank 20 for relieving excessive temperature and pressure therein in the event of other system component failures. A hot water supply line 81 penetrates upwardly through the top of tank 20 for supplying hot water for use other than for space heating (e.g., for domestic use).

Figure 5:
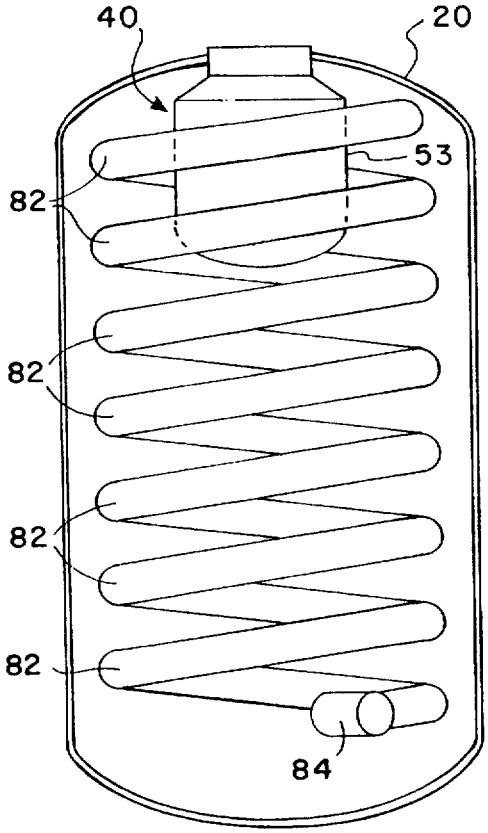
FIG. 5 is an elevation view of the interior of the water heating unit with a single helically wound tubular heat exchanger.

Referring to FIGS. 3 and 5, the products of combustion burned in combustion chamber 42 (FIG. 3) are exhausted therefrom by means of a helical tube 82 (FIG. 5) extending laterally outward from main body portion 53 and downwardly within tank 20. Tube 82 is preferably a 1¾" outside diameter stainless steel tube having a plurality of turns. As shown in FIG. 5, tube 82 terminates at a 2¼" diameter stainless steel manifold 84 at or near the bottom of tank 20. Tube 82 is in heat exchange relationship with the surrounding water in tank 20 for transferring heat to the water. By the time the products of combustion have reached manifold 84, at least some of the products of combustion have been condensed, thereby further enhancing the efficiency of apparatus 10. One end of manifold 84 protrudes outwardly from a bottom part of tank 20 for exhausting products of combustion therefrom and a condensate trap 86 extends downwardly from manifold 84 external to tank 20 (FIG. 1) for draining condensed products of combustion. A flue 88 extends upwardly from manifold 84 between casing 16 and tank 20 and penetrates the top part of casing 16. Flue 88 is adapted for engagement with an external flue (not shown) for exhausting non-condensed products of combustion upwardly through the top of casing 16 into a conventional exhaust system (not shown).

Figure 6:
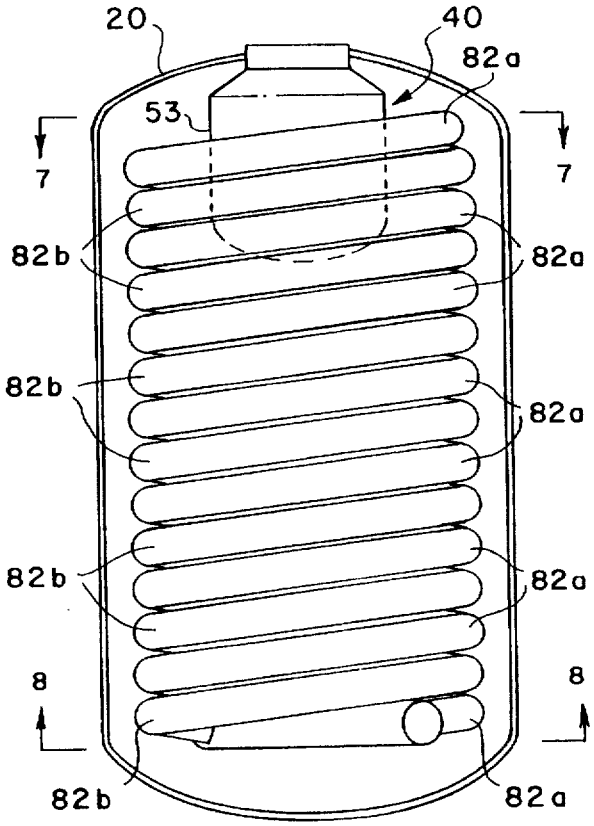
FIG. 6 is an elevation view of the interior of the water heating unit with a double helically wound tubular heat exchanger.

The turns of tube 82 are spaced at sufficient intervals along a central axis of tube 82 to accommodate another helical tube of the same diameter and configuration with each turn of the other helical tube interposed between successive turns of tube 82, as shown in FIG. 6. The spacing interval between successive turns of tube 82 should be slightly greater than the diameter of tube 82 to allow water to flow between adjacent turns when two helical tubes 82 are configured as shown in FIG. 6. For example, given a 1¾" outside diameter of tube 82, successive turns of tube 82 should be spaced so that there is an approximately 4 1/16" spacing between the center of each turn and the center of the next successive turn of tube 82. This spacing provides sufficient room for a 1¾" diameter turn of a second helical tube to be interposed between successive turns of tube 82 and allow an approximately ¼" space between adjacent turns in the dual tube configuration shown in FIG. 6.

Figure 7:
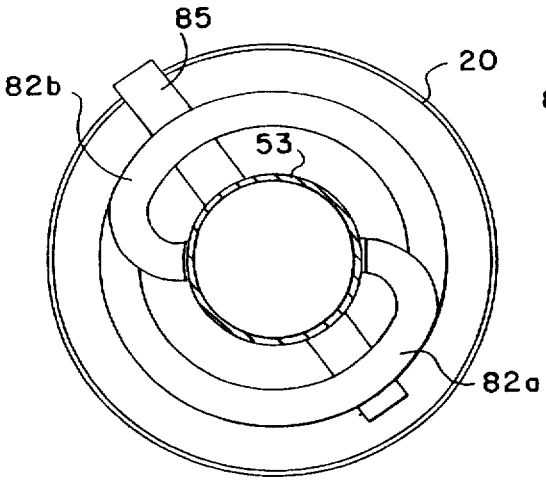
FIG. 7 is a sectional view taken along the line 7—7 of FIG. 6.
Figure 8:
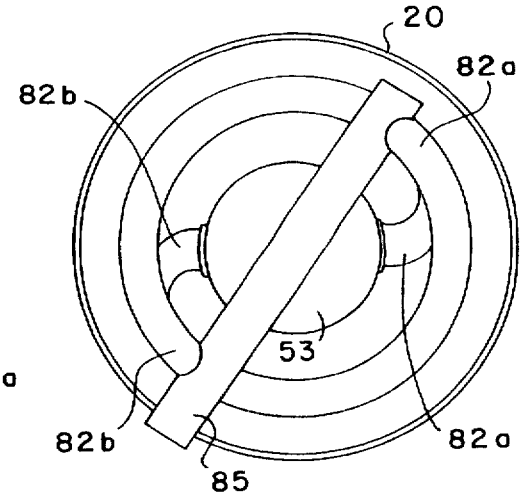
FIG. 8 is a sectional view taken along the line 8—8 of FIG. 6.

In the embodiment shown in FIGS. 6–8, two helical tubes **82*a* and 82*b* are provided for exhausting products of combustion from combustion chamber 42. Tubes 82*a* and 82*b* are each preferably 1¾" diameter stainless steel tubes. Tubes 82*a* and 82*b* extend outwardly from main body portion 53 of housing 40 at diametrically opposed positions thereon and downwardly within tank 20. Each tube 82*a*, 82*b* has a plurality of turns. Each of the turns of tube 82*a* is interposed between successive turns of tube 82*b* and is concentric therewith. By the same token, each of the turns of tube 82*b* is interposed between successive turns of tube 82*a* and is concentric therewith. Tubes 82*a* and 82*b* therefore form a tightly packed heat exchanger configuration, as can be best seen in FIG. 6. Tubes 82*a* and 82*b* are in heat exchange relationship with the surrounding water in tank 20 for transferring heat to the water. Tubes 82*a* and 82*b* terminate adjacent respective opposed ends of a manifold 85. By the time the products of combustion reach manifold 85, at least some of the products of combustion have been condensed, thereby further enhancing the efficiency of apparatus 10. One end of manifold 85 protrudes outwardly through tank 20** for exhausting products of combustion therefrom.

The use of two 1¾" stainless steel tubes **82*a*, 82*b*, wound together in a double helical configuration, increases the heat capacity of unit 12 without requiring any additional special tooling in order to form the double helical configuration. Each 1¾" tube 82*a*, 82*b* can be formed using a conventional helical tube forming machine. After tubes 82*a*, 82*b*** are individually formed, they are positioned to form the double helical configuration.

Figure 9A:
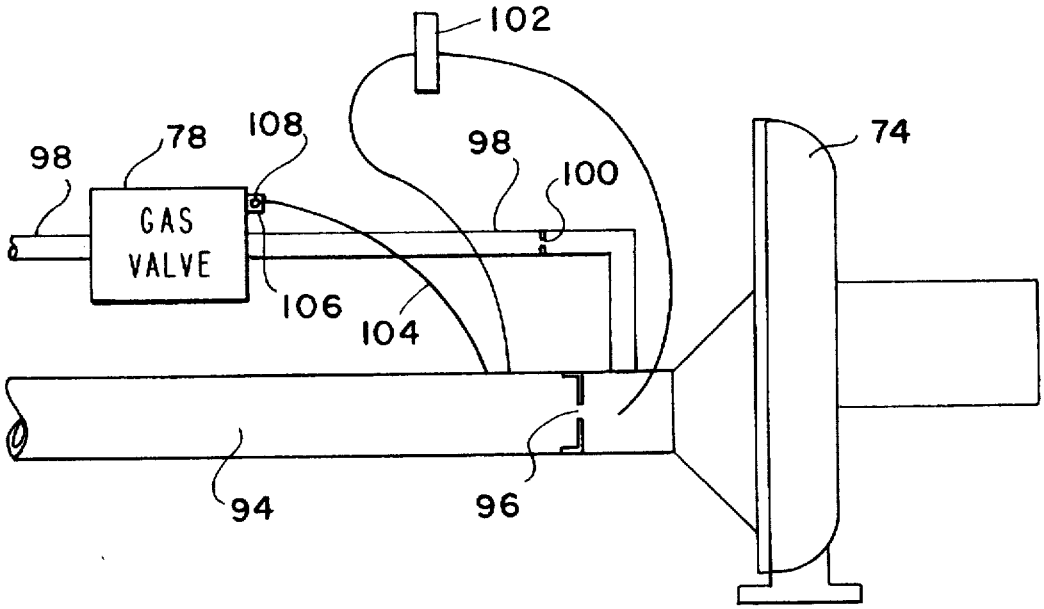
FIG. 9A is a schematic of a gas-air metering device for supplying a combustible gas-air mixture to the water heating unit.
Figure 9B:
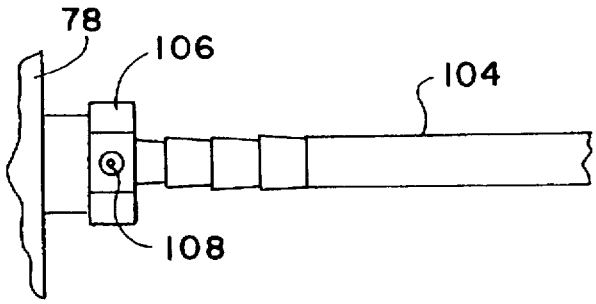
FIG. 9B is a detailed view of a portion of the gas-air metering device of FIG. 9A.

Referring to FIGS. 1, 9A and 9B, combustion air is supplied to a combustion air conduit 94 through air intake duct 76. An air flow restricting device, such as an orifice 96, is located in conduit 94. A gas supply conduit 98 is in fluid communication between gas valve 78 and conduit 94 downstream of orifice 96. A gas flow restricting device, such as an orifice 100, is located in gas supply conduit 98. A pressure switch sensor 102 measures the differential pressure across orifice 96. One skilled in the art will recognize that the differential pressure across orifice 96 is proportional to the air flow rate through orifice 96.

Gas valve 78 is preferably a pneumatically actuated gas metering valve (e.g., a pneumatically actuated gas metering valve of the type sold by White Rodgers, Honeywell or Robert Shaw) for controlling the flow rate of gas through conduit 98 in a predetermined proportion to the flow rate of air through orifice 96. One skilled in the art will recognize that the size of orifice 100 is selected relative to the size of orifice 96 and the respective pressures in lines 94 and 98 to provide a predetermined gas-air ratio. To control the flow of gas through conduit 98, gas valve 78 receives a biasing signal via line 104. Ordinarily, the biasing signal supplied to gas valve 78 through line 104 would represent the air pressure in conduit 94 upstream of orifice 96. By sensing the differential pressure across orifice 96, gas valve 78 determines the flow rate of air in conduit 94 and meters the flow of gas to conduit 98 accordingly.

Line 104 is coupled to gas valve 78 by means of a standard hexagonal coupling fitting 106. In accordance with the present invention, fitting 106 has an aperture 108 on the order of 0.035" in diameter. Aperture 108 communicates between the interior of line 104 and the external ambient environment to adjust the biasing signal. Because conduit 94 is on the suction side of combustion air blower 74, the pressure in conduit 94 is negative with respect to the external atmospheric pressure when blower 74 is operating. Aperture 108 functions as a rate averaging orifice to provide an adjusted biasing signal indicating an air pressure intermediate the actual air pressure in conduit 94 upstream of orifice 96 and atmospheric pressure. The greater the negative pressure in conduit 94, the more will be the adjustment of the biasing signal effected by aperture 108. This adjusted biasing signal causes gas valve 78 to increase the flow of gas through conduit 98, particularly in cases where extensive lengths of conduit 94 would otherwise tend to de-rate the gas flow below that required, because gas valve 78 senses a pressure differential across orifice 96 which is greater than the actual pressure differential. The result is that the gas-air ratio is biased toward a slightly rich mixture to ensure that the gas flow rate is sufficient to provide enough energy for intended use without over compensating and causing incomplete combustion.

Figure 10:
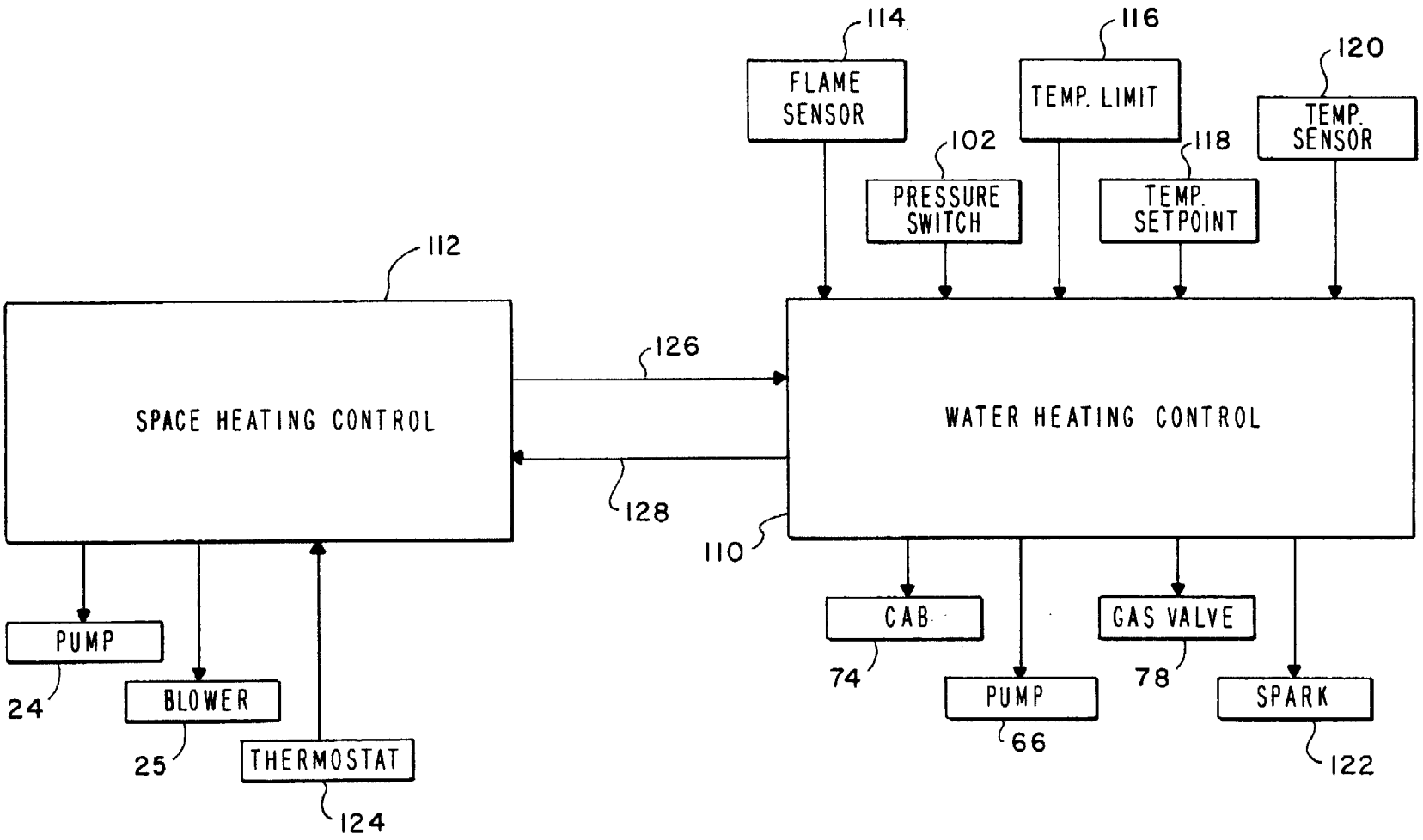
FIG. 10 is a block diagram of the electronic control system of the apparatus.

Referring to FIG. 10, water heating unit 12 is controlled by a water heating control module 110 and space heating unit 14 is controlled by a space heating control module 112. Control module 110 includes a microcontroller of the ST6225 type, sold by SGS-Thomson Microelectronics and control module 112 includes a microcontroller of the PIC16CR54 type, sold by Microchip. Control module 110 receives information from a plurality of sensors, including a flame sensor 114 (preferably a rectification-type flame sensor), pressure switch sensor 102, a temperature limit switch sensor 116, a temperature setpoint sensor 118 (preferably a potentiometer) for indicating a water temperature setpoint and a tank water temperature sensor 120 (preferably a thermistor) for sensing water temperature. The water temperature setpoint corresponds to the desired water temperature and may be changed by adjusting sensor 118. In turn, control module 110 controls combustion air blower (CAB)

74, gas valve 78, water circulating pump 66 and a spark igniter 122. Control module 112 receives input from an indoor thermostat 124, which indicates a space air temperature setpoint, and controls water circulation pump 24 and supply air blower 25 accordingly. The space air temperature setpoint corresponds to the desired air temperature of the space. Control module 110 communicates with control module 112. Specifically, control module 112 sends an electrical signal to control module 110, as indicated by arrow 126, in response to a demand for space heating received by control module 112 from thermostat 124. Control module 110 sends an electrical signal to control module 112, as indicated by arrow 128, in response to an indication from thermistor 120 that the tank water temperature has fallen below a minimum temperature threshold (e.g., 20° F. below the water temperature setpoint). Alternatively, instead of determining whether a low temperature condition exists with reference to a predetermined temperature differential (e.g., 20° F.) from a variable temperature setpoint, a constant minimum temperature may be used as the reference for determining whether a low temperature condition occurs. The "low temperature" signal sent by control module 110 to control module 112 causes control module 112 to inhibit operation of pump 24 and blower 25 unless blower 25 is set for "continuous fan" operation, as will be described in greater detail hereinafter.

Figure 16:
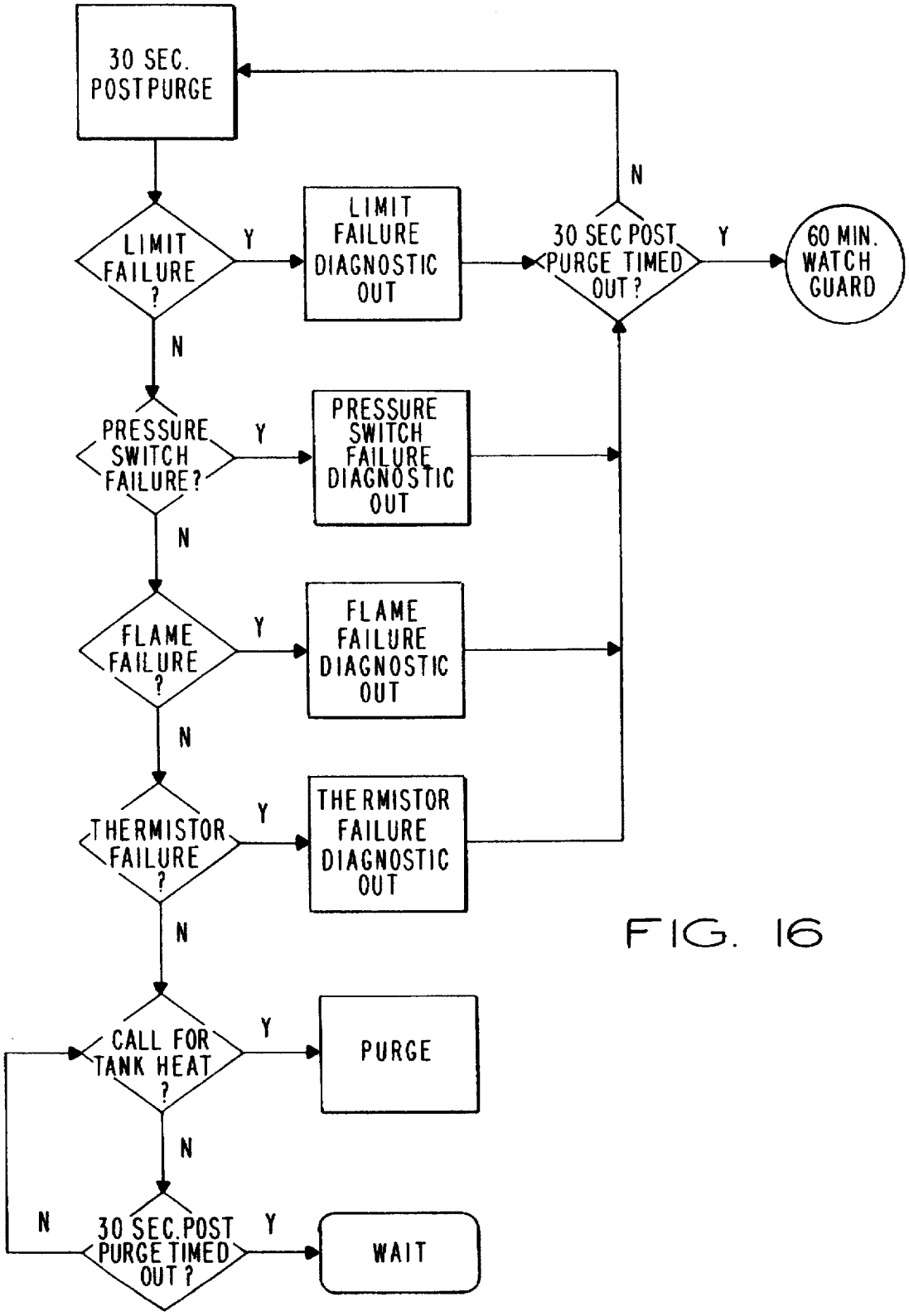
Figure 17:
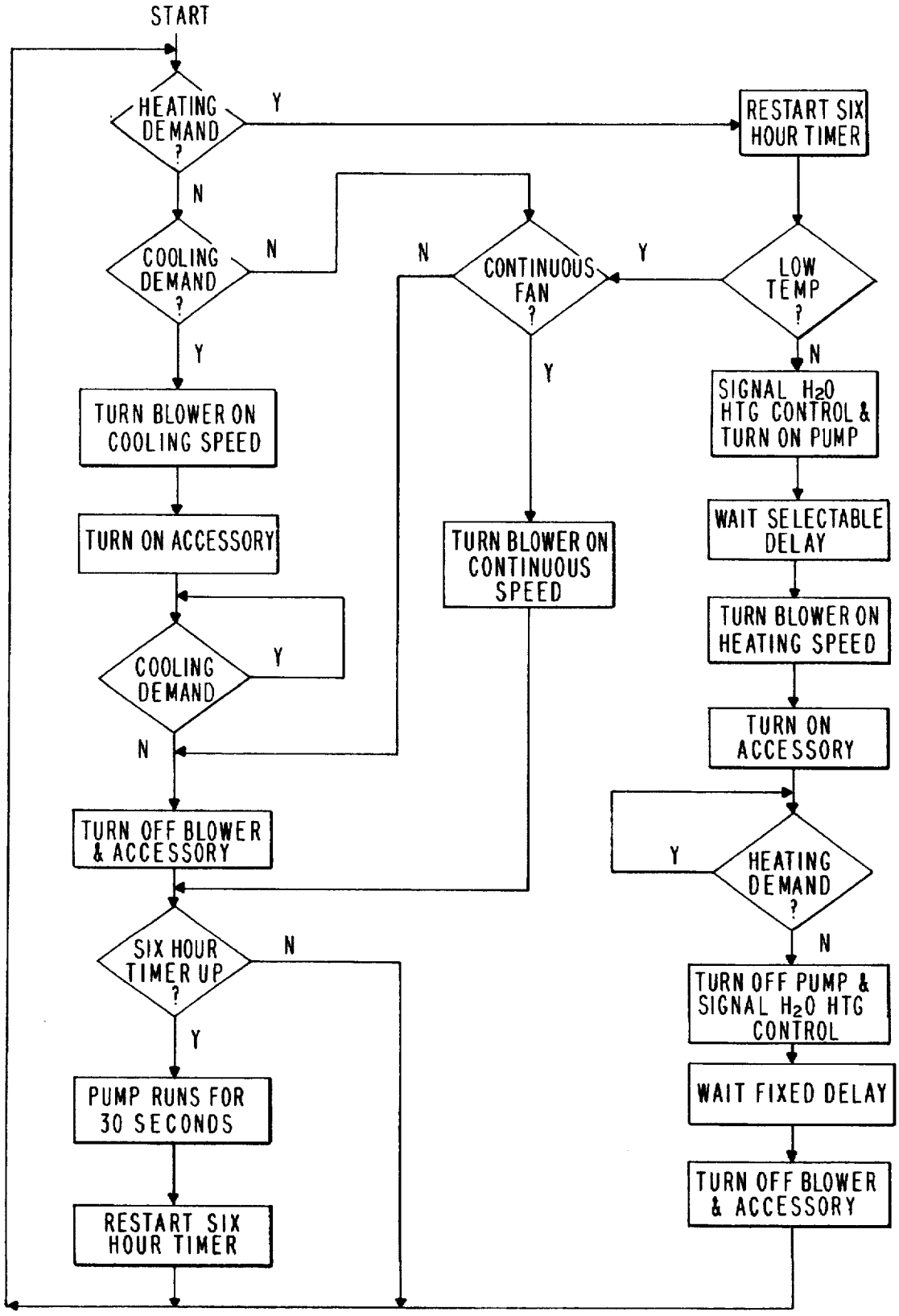
FIG. 17 is a flow diagram illustrating the control of the space heating unit.

The operation of apparatus 10 will now be described with reference to FIGS. 11–17. FIGS. 11–16 depict the control of water heating unit 12 and FIG. 17 depicts the control of space heating unit 14.

Figure 11:
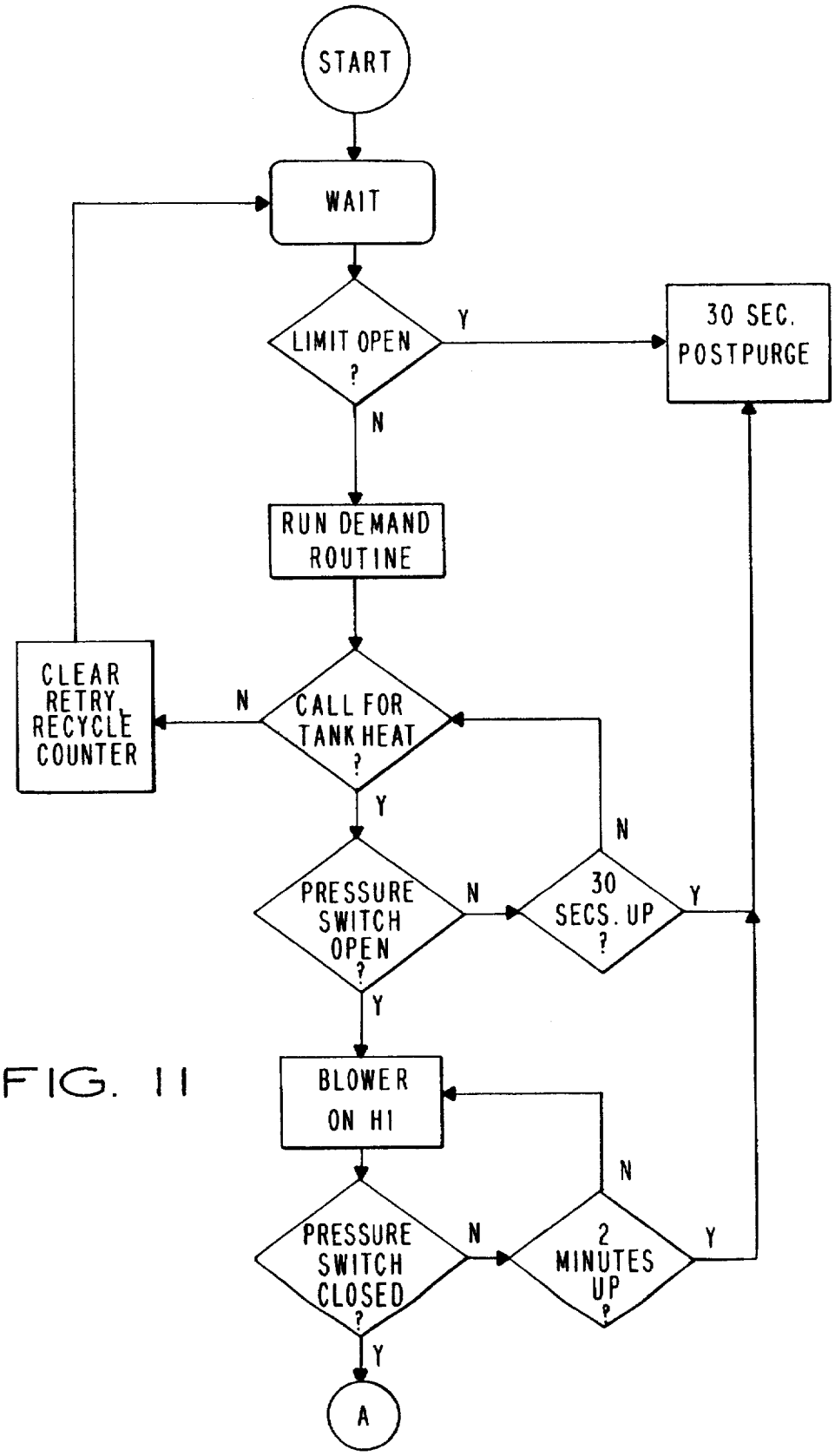
FIGS. 11–16 are flow diagrams illustrating the control of the water heating unit.

Referring to FIGS. 10 and 11, when thermistor 120 indicates that the tank water temperature has fallen below the temperature setpoint by a predetermined temperature increment (e.g., 3° F.), a call (demand) for tank heat is indicated. In response to a call for tank heat, control module 110 checks temperature limit switch sensor 116, which should be in a closed position. If it is not, a sensor failure is indicated and a Postpurge routine is initiated to purge combustion chamber 42 (FIG. 3) for thirty seconds. The Postpurge routine will be described in greater detail hereinafter.

If temperature limit switch sensor 116 is closed, a demand routine (FIG. 15) is run to determine if there is a call for tank heating. If there is not a call for tank heat, retry and recycle counters (not shown) are cleared and control module 110 waits for a call for tank heat. If there is a call for tank heat, control module 110 checks pressure switch sensor 102, which should be open. If sensor 102 remains closed for thirty seconds, a sensor failure is indicated and the Postpurge routine is implemented. If sensor 102 is open, combustion air blower 74 is turned on at high speed to blow combustion air into combustion chamber 42. If within two minutes after blower 74 is activated at high speed, pressure switch sensor 102 is still open, a sensor failure is indicated and control module 110 will initiate the Postpurge routine.

Figure 12:
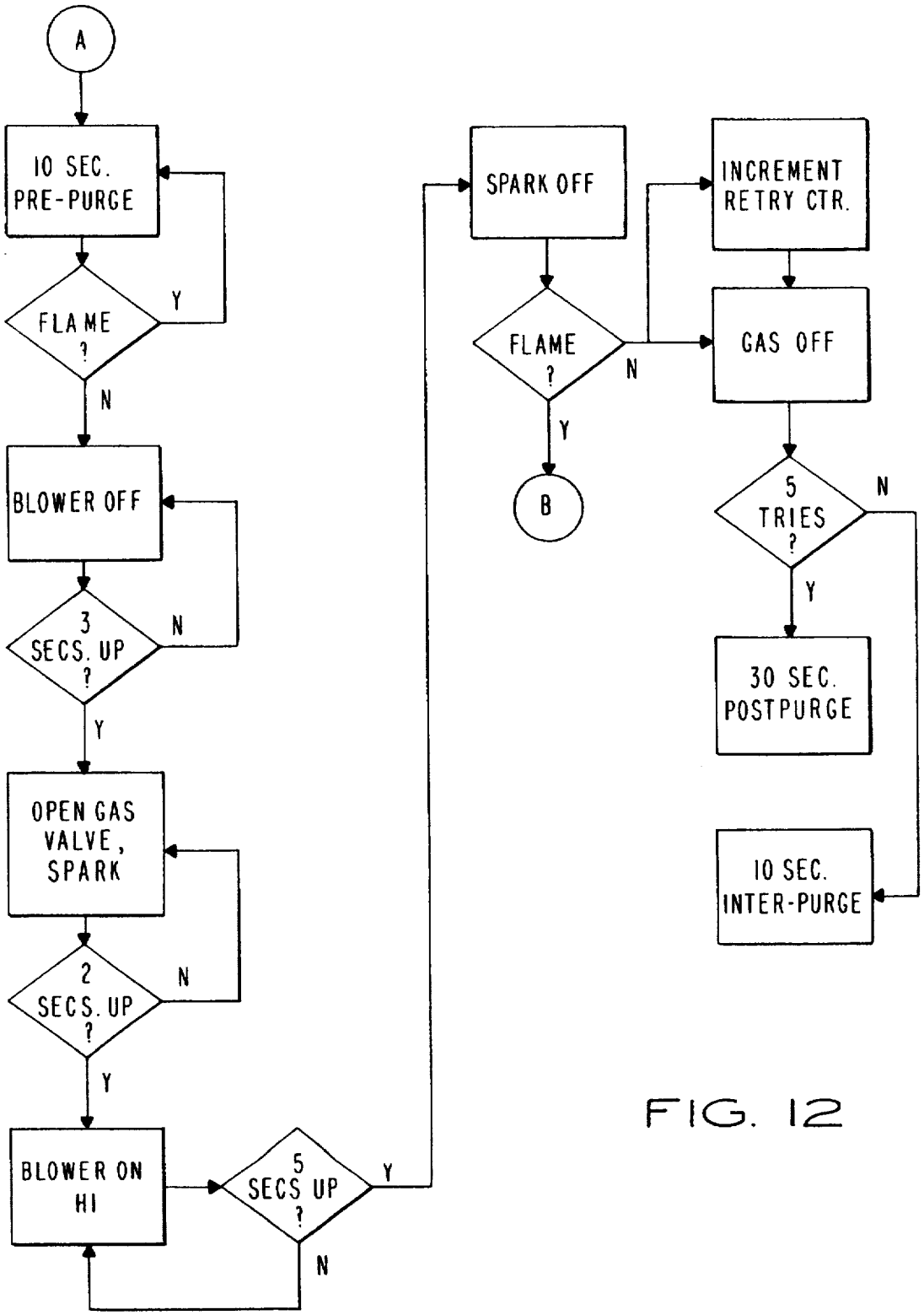
Figure 13:
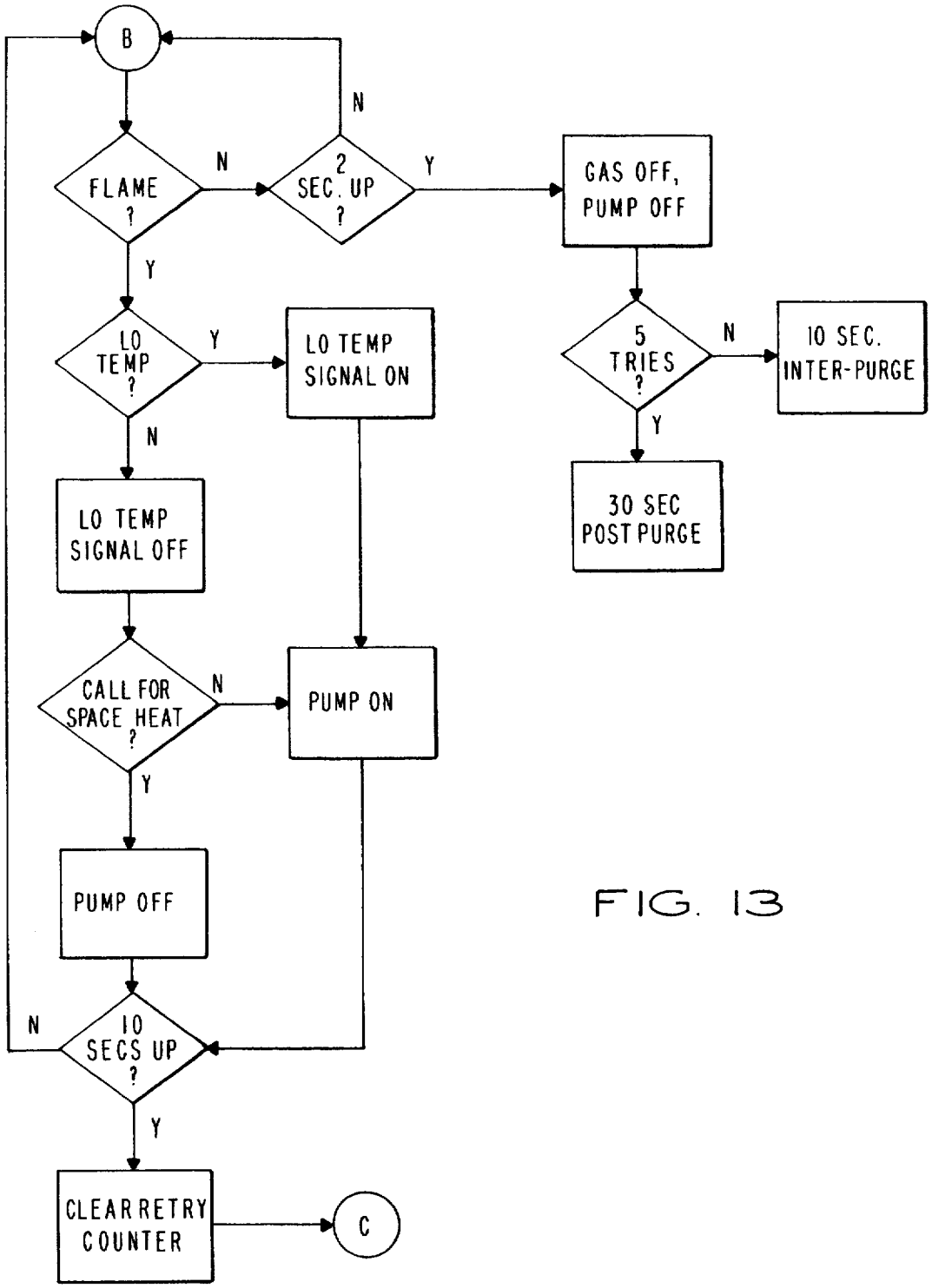

Referring to FIGS. 10 and 12, if pressure switch sensor 102 is closed within the two minute time parameter, control module 110 initiates a Prepurge routine to purge combustion chamber 42 for ten seconds prior to introducing a combustible gas-air mixture into burner 44 (FIG. 3). If a flame is detected by flame sensor 114 after Prepurge, the Prepurge routine is repeated until the flame is no longer detected. Upon completion of Prepurge, a Trial For Ignition routine is initiated, as depicted in FIG. 12. After completion of the Prepurge, blower 74 is turned off for three seconds. At the end of three seconds, gas valve 78 is opened and spark igniter 122 is activated to ignite the combustible gas-air mixture in burner 44. Blower 74 remains off for two seconds after gas valve 78 is opened and spark igniter 122 is activated. By turning off combustion air blower 74 during ignition, a gas-rich mixture is provided, which is ignitable at a low fire ("soft light") condition, thereby decreasing the noise and ignition pressures typically associated with direct ignition of a combustible gas-air mixture. At the end of the two second time delay, blower 74 is activated at high speed. After five more seconds, control module 110 deactivates spark igniter 122. If a flame is detected by flame sensor 114, control module 110 initiates a Flame Stabilization routine, as depicted in FIG. 13. If a flame is not detected, gas valve 78 is closed and the retry counter, which keeps track of the number of attempts to establish a flame, is incremented. An Interpurge routine is implemented to purge combustion chamber 42 for ten seconds after each unsuccessful attempt to establish a flame (up to a maximum of four times during any one call for tank heat cycle) before control module 110 makes another attempt to light burner 44. After the fifth try, if the flame is still not detected, the Postpurge routine is implemented.

Referring to FIGS. 10 and 13, if a flame is detected, a Flame Stabilization routine is initiated for a period of ten seconds, whereby the stability of the flame is monitored. Circulation pump 66 is activated in response to a flame being sensed by flame sensor 114. If there is a flame failure for a full two seconds during the ten second Flame Stabilization period, gas valve 78 is closed and pump 66 is deactivated. The Interpurge routine is initiated to purge combustion chamber 42 for ten seconds after each unsuccessful attempt to establish a flame (up to a maximum of four tries during any one call for tank heat cycle) before control module 110 makes another attempt to light burner 44. After the fifth try, if the flame is still not detected, the Postpurge routine is initiated.

If thermistor 120 indicates that the tank water temperature is 20° F. or more below the temperature setpoint, a low temperature signal (Lo Temp) is generated. This low temperature signal is transmitted from control module 110 to control module 112, as indicated by arrow 128 in FIG. 10, to prevent supply air blower 25 from operating. As long as a low temperature signal is present, circulation pump 66 remains on, irrespective of whether there is a call for space heating. If a low temperature signal is not present, a call for space heating signal transmitted from control module 112 to control module 110, as indicated by arrow 126, causes control module 110 to turn off pump 66. In some cases (e.g., where water heating unit 12 supplies hot water for multiple space heating zones), pump 66 may remain in operation even if there is a call for space heating, depending on the capacity of unit 12 and the extent of the call for space heating (e.g., where there is a call for space heating in only one of a plurality of space heating zones). When pump 66 is off, the hottest water in the vicinity of combustion chamber housing 40 (FIG. 3) is available for space heating. At the end of the ten second Flame Stabilization period, the retry counter is cleared.

Figure 14:
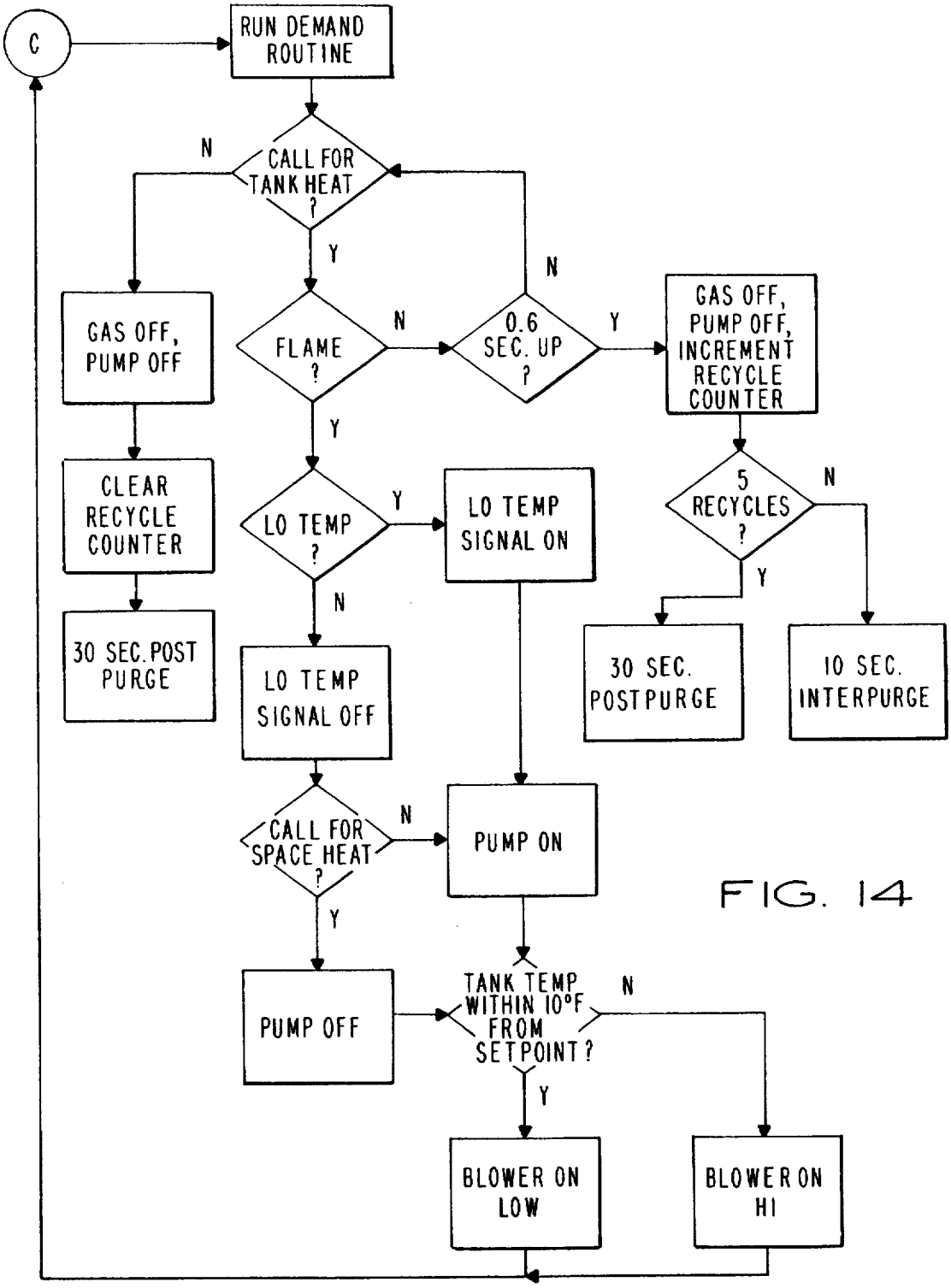

Once the flame is established and the ten second Flame Stabilization period has elapsed, a Burner Supervision routine is initiated, as shown in FIG. 14. Referring to FIGS. 10 and 14, the demand routine (FIG. 15) is run to determine if there is still a call for tank heat. If there is no call for tank heat, gas valve 78 is closed and circulation pump 66 is turned off. The Postpurge routine is implemented to purge combustion chamber 42 and the recycle counter, which keeps track of the number of attempts to re-establish the flame after a flame failure, is cleared. If there is still a call for tank heat, control module 110 continues the Burner Supervision routine to monitor the operation of burner 44.

If flame sensor 114 indicates a flame failure for a full 0.6 second during Burner Supervision routine, gas valve 78 is closed, pump 66 is turned off and the recycle counter is incremented. The Interpurge routine is initiated after each flame failure (up to a maximum of four flame failures during any one call for tank heat cycle) to purge combustion chamber 42 for ten seconds before attempting to re-establish the flame. After the fifth flame failure, the Postpurge routine is initiated.

If a flame failure does not occur, control module 110 determines whether a low temperature condition is present (i.e., tank water temperature 20° F. or more below temperature setpoint). If a low temperature condition is present, pump 66 will remain on, irrespective of whether there is a call for space heat. If a low temperature condition is not present, a call for space heat will result in pump 66 being turned off, as previously described. Until the tank water temperature is within 10° F. of the temperature setpoint, blower 74 will remain on at high speed. When the water temperature is within 10° F. of the temperature setpoint, blower 74 is reduced to low speed.

Figure 15:
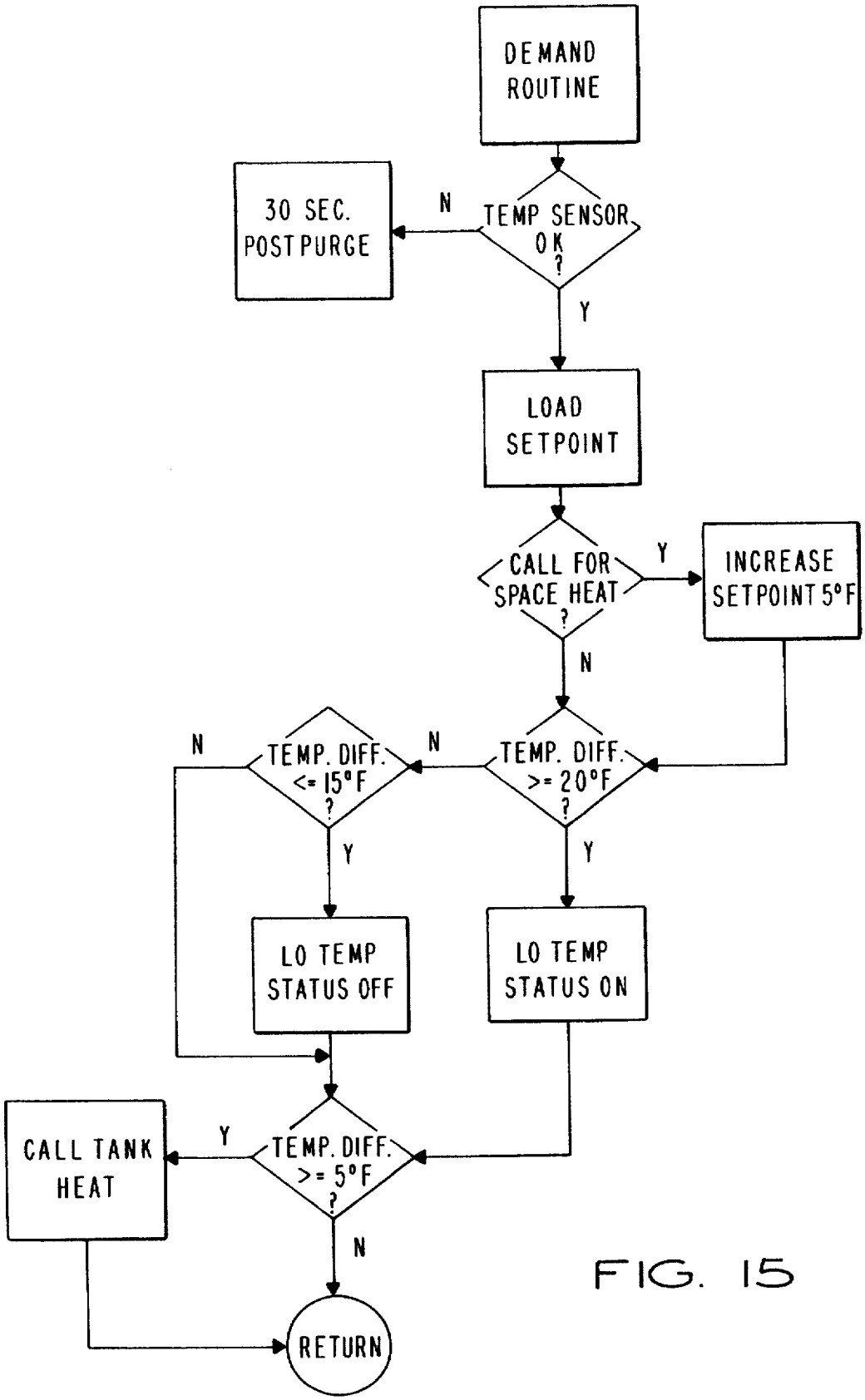

Referring now to FIGS. 10 and 15, the demand routine for determining whether there is a call for tank heat is depicted. Control module 110 determines if thermistor 120 is operable. If a thermistor failure condition is indicated, the Postpurge routine is initiated. If thermistor 120 is operable, the temperature setpoint from sensor 118 is loaded into the control program. If there is a call for space heat, the increased demand for hot water is anticipated by raising the previously loaded temperature setpoint by 5° F. As such, there is usually a call for tank heat in response to a call for space heat. However, if the tank water temperature was above the original water temperature setpoint (which may occur as a result of setpoint "overshoot" when the water is heated) when the call for space heat occurs, a call for tank heat may not occur (at least not immediately) in response to a call for space heat.

If the tank temperature is 20° F. or more below the temperature setpoint, the low temperature signal is generated. Once generated, the low temperature signal remains on until the tank water temperature is within 15° F. of the temperature setpoint. The demand routine generates a call for tank heat signal until the tank temperature is within 5° F. of the temperature setpoint. The Postpurge routine is initiated in response to the absence of a call for tank heat signal.

Although not shown in FIGS. 11–15, control module 110 continually monitors pressure switch sensor 102 and temperature limit switch sensor 116. If temperature limit switch sensor is detected in an open position, a high temperature limit condition is indicated. In response thereto, control module 110 shuts off the gas supply and initiates the Postpurge routine, which is depicted in FIG. 16. Similarly, if pressure switch sensor 102 is detected in an open position when blower 74 is on, a low combustion air pressure condition is indicated. In response thereto, control module 110 shuts off the gas supply and initiates the Postpurge routine. If the Postpurge routine is initiated as a result of flame failure or an abnormal condition indicated by any of the sensors 102, 116, 120, control module 110 initiates a Watchguard routine for approximately one hour after the Postpurge routine, as shown in FIG. 16. During the Watchguard routine, the entire water heating unit 12 is deactivated. If the Postpurge routine is initiated in response to the absence of a call for tank heat (e.g., satisfaction of a tank heating demand), the Watchguard routine is not implemented, as shown in FIG. 16.

Referring to FIGS. 10 and 17, the operation of space heating control module 112 will now be described. Control module 12 resets a six-hour timer (not shown) in response to a demand for space heating. The six-hour timer is used to ensure that water is circulated at least once every six hours between tank 20 (FIG. 1) and coil 22 (FIG. 1). In response to a low temperature signal (Lo Temp), blower 25 and related accessories (e.g., humidifier, dehumidifier, electrostatic air cleaner, etc.) are turned off unless blower 25 is set for continuous fan operation at thermostat 124, in which case blower 25 is turned on at continuous fan speed and the related accessories are turned on. Pump 24 does not circulate water between tank 20 and heat exchanger 22 in response to a low temperature signal from control module 110 so that the hot water in tank is available for use other than for space heating (e.g., domestic use).

If a low temperature signal is not present, control module 112 sends a demand for space heating signal, which occurs when the space air temperature falls below the thermostat setpoint by a predetermined temperature increment (e.g., 3° F.), to control module 110 and activates pump 24 to circulate water between tank 20 and coil 22. As previously described, control module 110 deactivates pump 66 in response to a demand for space heating signal if a low temperature signal is not present. Control module 112 waits a selectable delay period (e.g., 15, 30, 45 or 60 seconds) before activating blower 25. This selectable delay period allows time for the hot water to reach coil 22 before activating blower 25, to prevent an initial surge of cold air through the supply air duct. After the selectable delay period, blower 25 is turned on at heating speed (which is typically higher than the continuous fan speed) and the related accessories are turned on. When the space heating demand is satisfied, pump 24 is deactivated and control module 112 signals control module 110 that the space heating demand has been satisfied. Blower 25 remains on for an additional fixed delay period (e.g., 30 seconds) to extract residual heat from coil 22. At the end of the fixed delay period, blower 25 and the accessories are deactivated.

As previously described, cabinet 18 (FIG. 1) is adapted to receive an air conditioning coil (not shown) so that cabinet 18 forms part of a supply air duct for cooled air as well as heated air. In the event of a cooling demand, blower 25 is turned on at cooling speed (which is typically higher than heating speed) and the related accessories are also turned on. When the cooling demand is satisfied, blower 25 and the accessories are turned off. Water is not circulated between tank 20 and coil 22 when a cooling demand is present.

If water has not been circulated between tank 20 and coil 22 for six hours, as determined by the six hour timer, pump 24 is operated for thirty seconds to circulate water between tank 20 and coil 22. This periodic circulation prevents water in coil 22 and in conduits 26 and 34 (FIGS. 1 and 2) from becoming stagnant, thereby inhibiting the growth of bacteria and algae in coil 22 and in conduits 26 and 34. After pump 24 has operated for thirty seconds, the six hour timer is reset to begin counting a new six-hour period.

The combined water heating and space heating apparatus according to the present invention provides energy-efficient space heating and water heating. The space heating and water heating are coordinately controlled to give priority to the potable hot water supply over space heating if sufficient hot water is not available to satisfy both demands. The apparatus is programmed to try to prevent this condition from occurring by anticipating the hot water needed to satisfy a space heating demand. In response to a space heating demand, the tank temperature setpoint is raised by a predetermined amount (e.g., 5° F.) such that a demand for space heating usually triggers operation of water heating unit 12 to impart additional heat to the water in tank 20, even if the water was already at the original temperature setpoint when the space heating demand occurred. Hot water shortages should, therefore, not occur, except under extreme conditions.

The best mode for carrying out the invention has now been described in detail. Since changes in and modifications to the above-described best mode may be made without departing from the nature, spirit and scope of the invention, the invention is not to be limited to the best mode described hereinabove, but only by the appended claims and their proper equivalents.

We claim:

1. In combination:

water heating apparatus having a water storage tank, a heating device for heating water stored in said tank and a first temperature sensor for sensing water temperature in the tank and for providing a first electrical signal in response to said water temperature being at least a first temperature increment below a first temperature setpoint corresponding to a desired water temperature, said first electrical signal indicating a demand for water heating;

space heating apparatus having an air duct for supplying air to an indoor space, a heat exchanger for heating air supplied to the indoor space, an air mover for moving air over said heat exchanger and a second temperature sensor for sensing air temperature of the indoor space and for providing a second electrical signal in response to said air temperature being at least a second temperature increment below a second temperature setpoint corresponding to a desired air temperature, said second electrical signal indicating a demand for space heating;

a water circulating device for circulating water between said tank and said heat exchanger; and a control device adapted to control said heating device to heat the water in said tank in response to said first electrical signal and to control said water circulating device to supply heated water from said tank to said heat exchanger and to control said air mover to move air over said heat exchanger in response to said second electrical signal, whereby air to be supplied to the indoor space is heated, said control device being adapted to raise said first temperature setpoint by a predetermined amount in response to said second electrical signal.

2. The combination of claim 1 wherein said first temperature sensor is adapted to provide a third electrical signal in response to said water temperature being below a minimum temperature threshold, said control apparatus being adapted to prevent said water circulating device from circulating water between said tank and said heat exchanger and to prevent said air mover from moving air over said heat exchanger in response to said third electrical signal.

3. The combination of claim 2 wherein said minimum temperature threshold is below said first temperature setpoint by a predetermined third temperature increment which is greater than said first temperature increment.

4. The combination of claim 1 wherein said control apparatus is adapted to control said water circulating device to periodically circulate water between said heat exchanger and said tank, irrespective of whether said second electrical signal is present.

5. In a water heater having a water storage tank and a combustion chamber, ignition control apparatus, comprising:

a conduit in fluid communication with the combustion chamber;

an air supply device for delivering air to said conduit;

an air flow restrictor located in said conduit for metering the flow of air through said conduit;

a fuel supply device responsive to a pressure differential across said air flow restriction for delivering fuel to said conduit downstream of said air flow restrictor;

a fuel flow restrictor located between said fuel supply device and said conduit for metering the flow of fuel to said conduit;

a blower in fluid communication with said conduit downstream of said air flow restrictor for drawing air through said conduit and for introducing a combustible fuel-air mixture into the combustion chamber;

an igniter for igniting said fuel-air mixture in the combustion chamber; and a control device for enabling said igniter to ignite said fuel-air mixture in response to a demand for water heating and for disabling said blower for a predetermined time in response to said igniter being enabled.

6. Apparatus of claim 5 further including first and second lines in fluid communication between said fuel supply device and said conduit, said first line communicating with said conduit means upstream of said air flow restrictor and said second line communicating with said conduit downstream of said air flow restrictor, a difference in fluid pressure in said first and second lines corresponding to said pressure differential, said first line having an aperture communicating with an ambient environment external to said conduit to provide an air pressure biasing signal to said fuel supply device, said biasing signal representing an intermediate pressure between air pressure in said conduit upstream of said air flow restrictor and ambient air pressure.

7. Combined water heating and space heating apparatus, comprising:

a water heating unit having a water storage tank, a combustion device having a liquid impervious housing suspended within said tank from a top part of said tank such that said housing is substantially immersed in water when said tank is filled with water, said housing defining a substantially sealed combustion chamber inside said housing, said combustion device further including a burner located in said combustion chamber for burning a combustible fuel-air mixture, said water heating unit further including a first heat exchanger in fluid communication with said combustion chamber for exhausting products of combustion from said combustion chamber, said first heat exchanger being located in said tank to be in heat exchange relationship with water in said tank, said water heating unit further including a first water circulating device for circulating water in said tank;

a space heating unit having an air duct, a second heat exchanger located in said air duct and an air mover for moving air over said second heat exchanger, said space heating unit further including a second water circulating device for circulating water between said second heat exchanger and said tank, whereby heated water is supplied to said second heat exchanger; and a coupling device for releasably coupling said space heating unit with said water heating unit to allow said second water circulating device to circulate water between said second heat exchanger and said tank, said coupling device being adapted to couple said second heat exchanger in fluid communication with water in said top part of said tank, whereby heated water from said top part of said tank is supplied to said second heat exchanger and is returned from said second heat exchanger to said top part of said tank.

8. Apparatus of claim 7 further including first and second conduits communicating between said tank and said second heat exchanger, said first conduit being adapted to return water from said second heat exchanger to said tank, said second conduit being adapted to supply water from said tank to said second heat exchanger, said second water circulating device being cooperative with said first and second conduits to provide a circumferential flow of water around said housing to increase the temperature of the water supplied to said second heat exchanger.

9. Apparatus of claim 7 further includes a supply conduit for supplying water to said tank from a water source, said supply conduit extending downwardly through said tank from said top part to a bottom part of said tank, said first water circulating device including a pump having a suction line communicating with said top part for drawing water from said top part and a discharge line communicating with said supply conduit for discharging water drawn from said top part into said supply conduit, whereby water in said top part is discharged through said supply conduit into said bottom part.

10. Heating apparatus, comprising:

a tank for storing liquid, said tank having a top part and a bottom part;

a combustion device having a liquid impervious housing suspended within said tank from said top part, such that said housing is substantially immersed in the liquid when said tank is filled with the liquid, said housing defining a substantially sealed combustion chamber inside said housing, said combustion device further including a burner located in said combustion chamber for burning a combustible fuel-air mixture;

a first conduit in fluid communication with said combustion chamber for introducing said fuel-air mixture into said combustion chamber;

a second conduit in fluid communication with said combustion chamber for exhausting products of combustion from said combustion chamber; and said tank having an opening in said top part, said housing having a frusto-conical top portion and a substantially cylindrical main body portion below said frusto-conical top portion, said frusto-conical top portion protruding through said opening.

11. Apparatus of claim 10 wherein said top portion of said housing has an aperture through which said burner is insertable into and removable from said combustion chamber, said burner having a closure member for closing said aperture when said burner is positioned in said combustion chamber.

12. Apparatus of claim 11 wherein said housing has an annular top flange defining said aperture, said frusto-conical top portion including first and second frusto-conical sections, said first frusto-conical section being intermediate said flange and said second frusto-conical section, said flange extending inwardly from said first frusto-conical section, an upwardly facing surface of said flange being in contact with said closure member when said burner is positioned in said combustion chamber.

13. Apparatus of claim 12 wherein said second frusto-conical section and said main body are completely immersed in the liquid when said tank is filled with the liquid.

14. Apparatus of claim 13 wherein said first frusto-conical section protrudes through said opening.

15. Heating apparatus, comprising:

a tank for storing liquid, said tank having a top part and a bottom part;

a combustion device having a liquid impervious housing suspended within said tank from said top part, such that said housing is substantially immersed in the liquid when said tank is filled with the liquid, said housing defining a substantially sealed combustion chamber inside said housing, said combustion device further including a burner located in said combustion chamber for burning a combustible fuel-air mixture;

a first conduit in fluid communication with said combustion chamber for introducing said fuel-air mixture into said combustion chamber;

a second conduit in fluid communication with said combustion chamber for exhausting products of combustion from said combustion chamber; and said second conduit being comprised of at least one helical conduit which extends laterally outward from said housing and downwardly within said tank, said at least one helical conduit being located in said tank in heat exchange relationship with liquid stored in said tank.

16. Apparatus of claim 15 wherein said housing has a substantially cylindrical main body portion, said at least one helical conduit being comprised of first and second helical conduits extending laterally outward from said main body portion at diametrically opposed positions on said main body portion and downwardly within said tank, said first and second helical conduits being located in said tank in heat exchange relationship with liquid in said tank.

17. Apparatus of claim 15 wherein said at least one helical conduit is comprised of first and second helical tubes, each having a plurality of turns, each of the turns of said first helical tube being interposed between successive turns of said second helical tube and being concentric therewith.

18. Apparatus of claim 17 wherein said second conduit further includes a manifold located in a bottom part of said tank and extending laterally within said tank, said first and second helical tubes terminating at said manifold and being in fluid communication therewith, said manifold being adapted to be positioned in fluid communication with an external duct for exhausting products of combustion from said tank.

19. Apparatus of claim 15 wherein said at least one helical conduit is comprised of a helical tube having a plurality of turns, said turns being spaced at a sufficient distance along a central axis of said helical tube to accommodate another helical tube having a plurality of turns with each turn of the other helical tube interposed between successive turns of said helical tube.

* * * * *